US007452148B2

(12) United States Patent
Fukumoto et al.

(10) Patent No.: US 7,452,148 B2
(45) Date of Patent: Nov. 18, 2008

(54) LEAD HOLDING STRUCTURE OF MECHANICAL PENCIL

(75) Inventors: Takeo Fukumoto, Yokohama (JP); Kyo Nakayama, Yokohama (JP); Hitoshi Suzuki, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 190 days.

(21) Appl. No.: 10/597,774

(22) PCT Filed: Mar. 10, 2005

(86) PCT No.: PCT/JP2005/004242

§ 371 (c)(1),
(2), (4) Date: Aug. 7, 2006

(87) PCT Pub. No.: WO2005/090094

PCT Pub. Date: Sep. 29, 2005

(65) Prior Publication Data

US 2007/0172298 A1 Jul. 26, 2007

(30) Foreign Application Priority Data

Mar. 19, 2004 (JP) ..... 2004-079792

(51) Int. Cl.
*B43K 21/22* (2006.01)

(52) U.S. Cl. ..... 401/93; 401/92

(58) Field of Classification Search ..... 401/88, 401/92, 93, 94
See application file for complete search history.

(56) References Cited

U.S. PATENT DOCUMENTS

| | | | | |
|---|---|---|---|---|
| 4,358,210 | A * | 11/1982 | Hashimoto et al. | 401/65 |
| 5,098,212 | A * | 3/1992 | Smit | 401/92 |
| 6,334,728 | B1 * | 1/2002 | Suzuki | 401/67 |
| 6,547,466 | B2 * | 4/2003 | Kageyama et al. | 401/67 |
| 6,783,292 | B2 * | 8/2004 | Arai et al. | 401/92 |
| 6,854,909 | B2 * | 2/2005 | Fukumoto et al. | 401/92 |
| 2004/0265034 | A1 * | 12/2004 | Gu | 401/93 |

FOREIGN PATENT DOCUMENTS

| | | | |
|---|---|---|---|
| JP | 58-32958 | Y2 | 7/1983 |
| JP | 114981/1984 | U | 8/1984 |
| JP | 45192/1986 | U | 3/1986 |
| JP | 11683/1987 | U | 1/1987 |
| JP | 2-63078 | B2 | 12/1990 |
| JP | 3007446 | B2 | 2/2000 |
| JP | 2000-280683 | A | 10/2000 |

OTHER PUBLICATIONS

International Search Report of PCT/JP2005/004242, date of mailing Jun. 21, 2005.

* cited by examiner

*Primary Examiner*—David J Walczak
(74) *Attorney, Agent, or Firm*—Westerman, Hattori, Daniels & Adrian, LLP.

(57) ABSTRACT

A lead holding structure of a mechanical pencil where a predetermined lead holding force is maintained so that a lead does not move even if a writing pressure is repeatedly applied to the lead and where a so-called biting-off of a lead (break) is prevented without damaging the lead in repeatedly sending forward and backward operations.

2 Claims, 9 Drawing Sheets

LEAD HOLDING STRUCTURE OF MECHANICAL PENCIL

TECHNICAL FIELD

The present invention relates to an improvement of a lead holding structure of a mechanical pencil comprising a chuck through which a lead is inserted, and a fastener which is fitted over an outer periphery of the chuck to fasten the chuck to hold the lead.

BACKGROUND ART

FIGS. 7 to 11 show a conventional mechanical pencil.

As shown in FIG. 7, at a leading end area of a shaft cylinder 1, an outer periphery 11*b* of a chuck 11 at a position corresponding to a lead holding section is fitted into a fastener 12.

A chuck spring 7 is disposed between a shaft coupling 4 and a lead case 9 fixed to a rear end of the chuck 11. The chuck 11 is fastened by the fastener 12 by biasing force of the chuck spring 7, thereby holding the lead 10.

A holding chuck 8 made of resilient material such as rubber is fixed to a front portion of an inner hold of a front portion 3 threadedly mounted to a front end of the shaft cylinder 1. The lead 10 penetrates the holding chuck 8 and projects from the front portion 3.

From this state, the lead case 9 is knocked to move the chuck 11 forward, since the chuck 11 is fastened by the fastener 12, the lead 10 moves forward in a state where the lead 10 is held by the chuck 11.

If the lead 10 further moves forward, the fastener 12 abuts against an inner step 3*a* of the front portion 3 and its movement is stopped, and only the chuck 11 moves forward.

If the knock is released from this state, the chuck 11 is retracted in a state where the lead 10 is stopped by the holding chuck 8 (held), and the lead 10 is returned to a state shown in FIG. 7.

In a state where the fastener 12 is fitted to the chuck 11 from the retracted position again, the fastener 12 moves forward, and a front end of the fastener 12 abuts against an inner step 3*a* of the front portion 3. With this, the lead 10 is sent forward.

Next, a relation between the chuck 11 and the fastener 12 will be described in detail based on FIG. 8.

As shown in FIG. 8, an outer periphery 11*b* of the conventional chuck 11 corresponding to a lead holding section 11*a* is formed into an inclined surface 11*c*. The inclined surface is inclined gently through about 4° so as to obtain effective holding force. The conventional fastener 12 which is fitted over the outer periphery 11*b* of the chuck 11 is of cylindrical in shape, and its inner hole is a peripheral surface which is parallel to an axis of the inner hole.

Since the chuck 11 and the fastener 12 are formed in this manner, in a state where the lead 10 is held as shown in FIG. 8, the chuck 11 is fastened by the fastener 12 at the contact point 11*d* of the outer periphery of the chuck.

Here, a position where a line which is perpendicular to the inclined surface 11*c* of the chuck from the contact point 11*d* and an inner periphery of the lead holding section are intersecting with each other is a load application point 11*e* which functions as concentrated weight to the lead.

In the case shown in FIG. 8, in the length C (C=A+B) of the lead holding section 11*a*, the load application point 11*e* is at a position of A<B.

Next, a case in which a lead 10 having a slightly larger diameter is to be held will be explained based on FIG. 9.

In this case, in the length C (C=A+B) of the lead holding section 11*a*, the load application point 11*e* is at a position of A>B.

That is, in the case of the conventional chuck and fastener, since the inclination angle of the chuck is gentle, the position of the load application point 11*e* is largely varied due to a size error of an outer diameter of the chuck and due to variations of the diameter of the lead.

When a weight is applied to the lead in its axial direction by a writing pressure or the like, the chuck is further fastened, and the lead holding section further bites into the lead. The contact point 11*d* of the outer periphery of the chuck is deviated, and the load application point is further deviated as a result.

FIG. 10 is a transverse sectional view of the outer periphery 11*b* of the conventional chuck 11. A lead holding piece 11*b* will be explained based on FIG. 10. As shown in FIG. 10, the radius of curvature 11*g* of the lead holding section of the chuck 11 (lead holding piece 11*b*) is set slightly smaller than a radius 10*a* of the lead 10.

As a result, opposite angle portions of each of the lead holding pieces 11*h* divided by slots 11*f* bite into the lead 10, and the lead holding force is enhanced.

However, in the chuck 11 (lead holding piece 11*b*) shown in FIG. 10, both angle portions of the lead holding piece 11*b* bite into the lead 10, the lead is damaged, and when weight is repeatedly applied to the lead, there is a fear that biting-off (break) is caused.

As an improvement thereof, Japanese Patent Application Laid-open No. 2000-280683 (patent document 1) describes that if the radius of curvature of the lead holding section of the chuck is set equal to or slightly greater than a radius of a lead to be used, the lead can be used without breaking the same.

Further, as shown in FIG. 11, the lead holding section 11*a* of the conventional chuck 11 formed with fine thread projections and depressions 11*i* (height is about 50μ) is used. This has effective effect for increasing the lead holding force of the chuck 11.

However, this is not preferable because this damages the lead and the biting-off of the lead is caused.

Patent Document 1: Japanese Patent Application Laid-open No. 2000-280683

DISCLOSURE OF THE INVENTION

Problem to be Solved by the Invention

The present invention has been accomplished to solve the above problem, and it is an object of the invention to provided a lead holding structure of a mechanical pencil where a predetermined lead holding force is maintained so that a lead does not move even if a writing pressure is repeatedly applied to the lead and where a so-called biting-off of a lead (break) is prevented without damaging the lead in repeatedly sending forward and backward operations.

Means for Solving Problem

The present invention has been accomplished to achieve the above object, and the invention provides a lead holding structure of a mechanical pencil in which a lead is held through a fastener by forward and backward movements of a chuck disposed in front of a shaft cylinder, and the lead is pushed out, wherein a portion of an outer periphery of the chuck corresponding to a lead holding section from a substantially central point to a front end of the outer periphery is formed as a peripheral surface which extends substantially parallel to an axis or which inclines toward the axis of the mechanical pencil, and a portion of the outer periphery from the substantially central point to a rear end of the outer periphery is formed as a surface which is perpendicular to the axis or as a peripheral surface which is inclined toward the axis, an inner periphery of the fastener to which the outer periphery of the chuck is formed as an inclined surface which is inclined toward the axis rearward through a predetermined angle, when the chuck holds the lead and is fastened by the fastener, a central point of the outer periphery of the chuck becomes a contact point with respect to the inclined surface of the fastener, and a point at which a line perpendicular to the inclined surface from the contact point and the inner periphery of the lead holding section of the chuck intersect with each other is a load application point of holding the lead, the load application point is set substantially at a center of a lead holding length.

The present inventors researched an improvement for moderating a biting-off (break) of a lead, and found that as a load application point is closer to a front end or a rear end of a lead holding section, the lead is more damaged by an angle of the end of the lead holding section, and the most preferable structure to moderate the damage is to locate the load application point on a center of a lead holding length of the chuck.

With this structure, the load application point can be located at substantially center of the lead holding length, and the damage on the lead can be suppressed.

If the chuck and the fastener have the above structure, the load application point can easily be located at the center of the lead holding length of the chuck even if the size precision of normal machining is not uniform.

Here, it is preferable that a radius of curvature of the lead holding section of the chuck is set in a range of 90% or more and 100% or less of a radius of the lead. With this range, damage on the lead can be suppressed more excellently.

It is preferable that an inner surface of the lead holding section of the chuck is formed with projections and depressions of 10μ or less. If the inner surface of the lead holding section is formed with the projections and depressions of 10μ or less, the lead can be held appropriately without damaging the lead.

EFFECT OF THE INVENTION

According to the present invention, the chuck and the fastener have the above structures. Therefore, even if the size precision for normally machining is varied and the diameters of the leads are varied, the load application point can be set to a center of the lead holding length of the chuck. When a weight in the axial direction of the lead is applied due to the writing pressure, the chuck is not fastened and the lead holding section does not bite into the lead, the contact point of the chuck outer periphery does not deviate, and the load application point can always be the center of the lead holding length of the chuck.

As a result, a lead holding force is maintained so that a lead does not move even if a writing pressure is repeatedly applied to the lead and a biting-off of a lead (break) is prevented without damaging the lead in repeatedly sending forward and backward operations.

BEST MODE FOR CARRYING OUT THE INVENTION

An embodiment of the present invention will be explained based on FIGS. 1 to 3.

FIG. 1 shows an essential portion of a knock type mechanical pencil according to an embodiment. The invention is characterized in a chuck 5 and a fastener 6, and other structure is basically the same as that of the conventional knock type mechanical pencil.

As shown in FIG. 1, a fastener 6 is fitted over an outer periphery 5*b* of a chuck 5 at a location corresponding to a lead holding section 5*a* of the chuck 5. The chuck 5 over which the fastener 6 is fitted is inserted into an axial hold of a shaft coupling 4 from a rear end of the chuck 5.

A front end of a chuck spring 7 abuts against a rear end of the shaft coupling 4. A lead case 9 abuts against a rear end of the chuck spring 7. A rear end of the chuck 5 is fixed to a front end of the lead case 9.

The shaft coupling 4 is inserted into an axial hole from a front end of the shaft cylinder 1, and a flange provided on a front end of the shaft coupling 4 is retained to a front end of the shaft cylinder 1.

An inner step 3*a* is formed on a front end of an inner periphery of the front portion 3, and a holding chuck 8 made of resilient material such as rubber is fixed to a front end in an inner hold. The front portion 3 may be a resin product, and the holding chuck 8 may be formed as an integral resilient piece.

The front portion 3 is fixed to the shaft cylinder 1 by threading means in a state where a flange provided on a front end of the shaft coupling 4 is held between a front end of the shaft cylinder 1 and the inner step 3*a*. In FIG. 1, a symbol 2 represents a grip mounted on the shaft cylinder 1.

In a state shown in FIG. 1, the lead 10 penetrates the holding chuck 8 and projects from a front end of the front portion 3.

From this state, if the chuck 5 is knocked and moved forward, since the chuck 5 is fastened by the fastener 6, the lead 10 moves forward in a state where it is held.

If the lead 10 is further moved forward, the fastener 6 abuts against the inner step 3*a* of the front portion 3 and then, only the chuck 5 moves forward in a state where the chuck 5 opens.

From this state, if the knock is released, the lead 10 is stopped (held) by the holding chuck 8 and in this state, the chuck 5 is retracted and returned to the state shown in FIG. 1.

The lead 10 further moves forward in a state where the fastener 6 is fitted to the chuck 5 from the retracted position, the front end of the fastener 6 abuts against the inner step 3*a* of the front portion 3, thereby sending the lead 10 forward. As described above, this operation is the same as that of the conventional knock type mechanical pencil.

Next, the chuck 5 and the fastener 6 which are features of the present invention will be explained based on FIGS. 2 and 3.

As shown in FIG. 2, the chuck 5 is formed with an outer periphery 5*b* corresponding to the lead holding section 5*a* as a peripheral surface (horizontal section 5*c*) which is parallel to an axis (not shown) from a front end. A rear end of the horizontal section 5*c* of the chuck 5 is formed at a substantially central point of the outer periphery 5*b* corresponding to the lead holding section 5*a*.

An inclined peripheral surface (inclined surface 5*d*) which is inclined toward the axis is provided behind a rear end of the horizontal section 5*c*.

The inner periphery of the fastener 6 to which the outer periphery 5*b* of the chuck 5 is fitted is provided with an inclined surface 6*a*. The inclined surface 6*a* is inclined toward the axis from its front end toward the rear end.

Since the chuck 5 and the fastener 6 are formed in this manner, when the chuck 5 holds the lead 10 and is fastened by the fastener 6, the rear end of the horizontal section 5*c* of the chuck 5 functions as the contact point 5*e* with respect to the inclined surface 6*a* of the fastener 6.

A point at which a line perpendicular to the inclined surface 6*a* from the contact point 5*e* and an inner periphery of the lead holding section 5*a* of the chuck 5 intersect with each other becomes the load application point 5*f* for holding the lead. The length of the horizontal section 5*c* and the angle of the inclined surface 6*a* of the fastener 6 are set such that the load application point 5*f* becomes a substantially center of the lead holding length C.

That is, the length and the angle are set such that the load application point 5*f* comes at the position of A=B with respect to the length C (C=A+B) of the lead holding section 5*a*. More specifically, the inclined surface 6*a* of the fastener 6 is inclined gently through about 3° to obtain an effective holding force.

Since the chuck 5 and the fastener 6 are formed into the specific shapes, even if there are size error in outer diameter of the chuck and variation in lead diameter, the position of the load application point 5*f* is not varied.

FIG. 3 shows a slightly thick lead for example. In this case also, the rear end of the horizontal section 5*c* of the chuck 5 becomes the contact point 5*e* with respect to the inclined surface 6*a* of the fastener 6, and a point where a line perpendicular to the inclined surface 6*a* from the contact point 5*e* and the inner periphery of the lead holding section 5*a* of the chuck 5 becomes the load application point 5*f* for holding the lead.

Therefore, the load application point 5*f* for holding the lead is located at the position of A=B, and the position of the load application point 5*f* for holding a lead is not varied as compared with the case shown in FIG. 2.

The position of the load application point 5*f* for holding the lead is not varied also in a case where there is a size error in the chuck outer diameter in addition to the case where the lead diameter is varied.

In this embodiment, the outer periphery 5*b* corresponding to the lead holding section 5*a* of the chuck 5 is formed as the horizontal section 5*c* and the inclined surface 5*d*. Alternatively, a portion of the outer periphery 5*b* from its substantially central point to its front end may be formed as a inclined peripheral surface which is inclined toward the axis, and a portion of the outer periphery 5*b* from its substantially central point to its rear portion may be formed as an inclined peripheral surface which is inclined toward the axis or a surface perpendicular to the axis.

In this case, when the chuck 5 holds the lead 10 and is fastened by the fastener 6, a central point of the large diameter of the chuck 5 (outer periphery 5*b*) becomes only one contact point with respect to the inclined surface of the fastener.

Therefore, in this case also, a point (load application point) at which a line perpendicular to the inclined surface from the contact point and the inner periphery of the lead holding section of the chuck intersect with each other becomes a substantially center of the lead holding length.

As shown in FIG. 4, radius of curvature of lead holding section 5*h* is equal to or slightly smaller than the radius 10*a* of the lead and is set in a range of 90 to 100% of the radius 10*a* or the lead. FIG. 4 is a transverse sectional view of the outer periphery 5*b* of the chuck 5.

If the radius of curvature of lead holding section 5*h* of the chuck 5 is 90% or less of the radius 11*a* of the lead, the lead is damaged and when a weight is applied to the lead, the probability that the biting-off (break) of the lead is caused is increased. If the radius of curvature of lead holding section 5*h* of the chuck 5 is 100% or more of the radius 10*a* of the lead, the lead holding force is reduced.

As shown in FIGS. 5 and 6, the inner surface of the lead holding section 5*a* of the chuck 5 is formed with projections and depressions of 10μ or less.

FIG. 5 shows that the lead holding section 5*a* of the chuck 5 is formed with fine projections and depressions (height is about 0.5 to 10μ) by a special tool, and FIG. 6 shows the lead holding section 5*a* is formed with fine projections and depressions (height is about 0.6μ) by nitric acid processing.

In any of the cases, although the lead holding force is slightly lower than a surface formed with screw-like projections and depressions by tapping as in the conventional technique, a lead is not damaged, and the lead can be held with appropriate force.

Embodiment (Experiment 1)

Experiments and comparisons were performed concerning damages of leads using the lead holding structure of a mechanical pencil shown in FIGS. 2 and 3 as embodiments and the conventional lead holding structure of a mechanical pencil shown in FIGS. 8 and 9 as comparative examples.

In the experiment 1, a longitudinal central portion of a lead is held by a chuck, the fastener is fixed, the chuck is pulled rearward in this state, and damages of different weights (rearward tension: ON (no load), 3N, 5N, 10N) is given to a held portion of the lead. The holding of the lead was released, both ends of the taken out lead were supported, and a weight was applied to the central held portion, and bending stress (converted breaking strength) was measured.

The bending stress (converted breaking strength) was obtained by $\sigma=8PL/\pi d^3$. Here, σ: bending stress (MPa), P: actually measured load when lead is broken (N), L: distance between supported points (mm) and d: diameter of lead (mm).

Ten leads were used in each of the examples and comparative examples, and average values of the bending stress (converted breaking strength) were obtained. A mechanical pencil lead (MITSUBISHI PENCIL CO., LTD.) having an inner diameter of the lead holding section of ϕ0.54, a diameter of the lead of ϕ0.564 and a hardness of HB was used in the both examples. A result thereof is shown Table 1 (graph) and Table 2 (data).

TABLE 1

Damage on lead of chuck in which weight point is varied and on lead of chuck in which weight point is constant

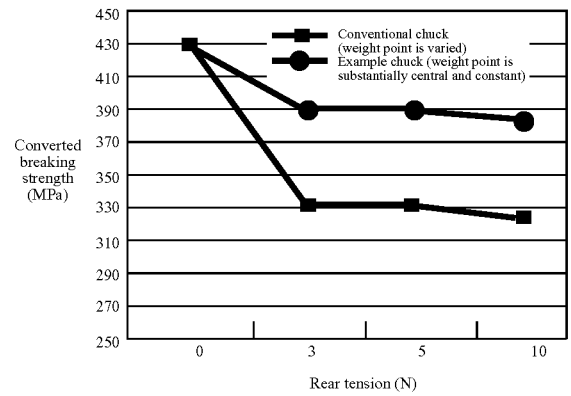

TABLE 2

| Comparison between conventional chuck (weight point is varied) and example (weight point is substantially central and constant) | | |
|---|---|---|
| Rear tension (N) | Conventional chuck | Example chuck |
| 0 | 426.9 | 424.3 |
| 3 | 333.6 | 389.7 |
| 5 | 332.1 | 388.9 |
| 10 | 326.5 | 375.5 |

Average value of loads n = 10 (MPa)

The rear tension 5N (newton) is a state where a normal chuck is biases rearward by a chuck spring with respect to the fastener, and from the above result, it can be said that in the case of the conventional lead holding structure of a mechanical pencil, the lead is prone to be broken. If the bending stress when a lead is broken is 330 MPa or less, the probability of generation of breaking of lead is high when writing, and if the bending stress is 370 MPa or higher, the probability of generation of breaking of lead is low.

(Experiment 2)

Experiments and comparisons were performed concerning damages of leads using the lead holding structure of a mechanical pencil shown in FIGS. 2 and 3. At that time, in the example, the load application point is located at a position of A=B (center) with respect to the length C (C=A+B) of the lead holding section 5*a*. In the comparative example, the load application point is located at a position of ⅗ from the front end with respect to the length C (C=A+B) of the lead holding section 5*a*. That is, the load application point is located at a position of ⅖ from the rear end of the lead holding section 5*a*.

In the experiment 2 also, like the experiment 1, a longitudinal central portion of a lead is held by a chuck, the fastener is fixed, the chuck is pulled rearward in this state, and damages of different weights (rearward tension: ON (no load), 3N, 5N, 10N, 15N, 20N) is given to a held portion of the lead. The holding of the lead was released, both ends of the taken out lead were supported, and a weight was applied to the central held portion, and bending stress (converted breaking strength) was measured.

Ten leads were used in each of the examples and comparative examples, and average values of the bending stress (converted breaking strength) were obtained. A mechanical pencil lead (MITSUBISHI PENCIL CO., LTD.) having an inner diameter of the lead holding section of ϕ0.54, a diameter of the lead of ϕ0.564 and a hardness of HB was used in the both examples. In both the examples and comparative examples, the radius of curvature of lead holding section (holding diameter) with respect to the lead diameter is 94%. The example is described as "weight point is substantially center", and the comparative example is described as "weight point is on the rear side", and a result thereof is shown in Table 3 (graph) and Table 4 (data).

TABLE 3

Damage on lead caused by difference in weight point (holding diameter with respect to lead diameter is 94%)

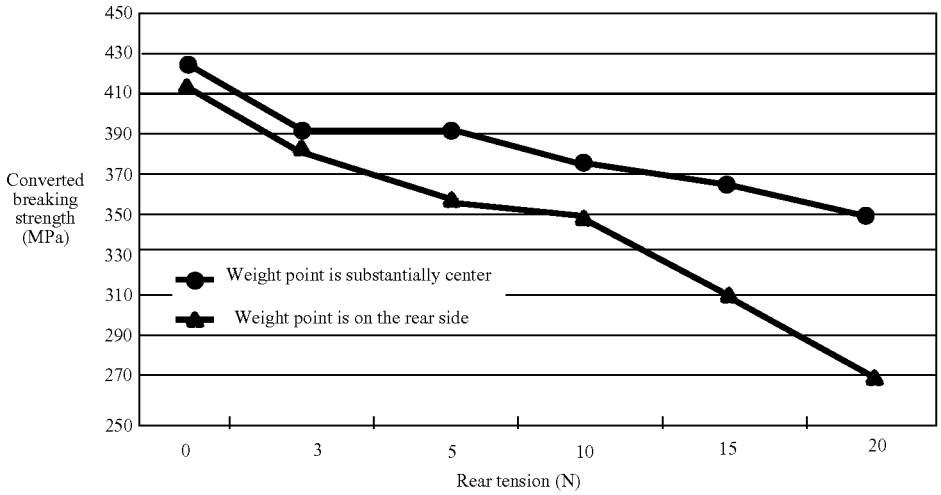

TABLE 4

| Damage on lead caused by difference in weight point Holding diameter with respect to lead diameter is 94% | | |
|---|---|---|
| Rear tension (N) | Weight point is substantially center | Weight point is on the rear side |
| 0 | 424.3 | 415.4 |
| 3 | 389.7 | 383.6 |
| 5 | 388.9 | 358.2 |
| 10 | 375.5 | 348.7 |
| 15 | 361.2 | 310.3 |
| 20 | 351.5 | 269.7 |

(MPa)

As apparent from the experiment 2, if the load application point is moved from the substantially center to rear, the damage on the lead is increased, and the lead breaking strength is lowered.

(Experiment 3)

Comparisons and experiments were performed concerning damage on lead caused by difference in radius of curvature of lead holding section (holding diameter) with respect to lead diameter using the lead holding structure of a mechanical pencil shown in FIGS. 2 and 3.

At that time, in the example, the load application point is located at a position of A=B (center) with respect to the length C (C=A+B) of the lead holding section 5*a*, and the holding diameter is 96%, 94%, 89% (reference example) with respect to the lead diameter.

In the experiment 3 also, like the experiment 2, a longitudinal central portion of a lead is held by a chuck, the fastener is fixed, the chuck is pulled rearward in this state, and damages of different weights (rearward tension: ON (no load), 3N, 5N, 10N, 15N, 20N) is given to a held portion of the lead. The holding of the lead was released, both ends of the taken out lead were supported, and a weight was applied to the central held portion, and bending stress (converted breaking strength) was measured.

Ten leads were used in each of the examples and comparative examples, and average values of the bending stress (converted breaking strength) were obtained. A mechanical pencil lead (MITSUBISHI PENCIL CO., LTD.) having an inner diameter of the lead holding section of ϕ0.54, a diameter of the lead of ϕ0.564 and a hardness of HB was used in the both examples. The example is described as "weight point is substantially center 96%, weight point is substantially center 94%", and the reference example is described as "weight point is substantially center 89%", and a result thereof is shown in Table 5 (graph) and Table 6 (data).

TABLE 5

Damage on lead caused by variation in holding diameter with respect to lead diameter

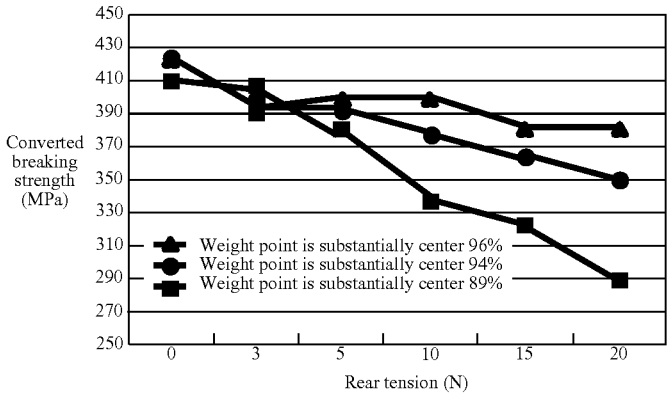

TABLE 6

Damage on lead caused by variation in holding diameter with respect to lead diameter

| Rear tension (N) | Weight point is substantially center 96% | Weight point is substantially center 94% | Weight point is substantially center 89% |
|---|---|---|---|
| 0 | 424.3 | 424.3 | 412.3 |
| 3 | 389.7 | 389.7 | 396.9 |
| 5 | 392.4 | 388.9 | 380.4 |
| 10 | 393.2 | 375.5 | 334.2 |
| 15 | 377.9 | 361.2 | 322.1 |
| 20 | 379.7 | 351.5 | 288.7 |

Average value of load n = 10 (MPa)

Even if the weight point is substantially center, if the holding diameter becomes smaller than the lead diameter, damage on the lead is increased, and the lead is prone to be broken.

Especially when the holding diameter is 89%, no difference is found with respect to the case where the weight point is on the rear side in the experiment 2, and it is necessary that the holding diameter is 90% or higher to reduce the damage on the lead.

If the holding diameter is increased, the damage is reduced, but the holding force is reduced. To obtain sufficient lead holding force, it is preferable that the holding diameter with respect to the lead diameter is 100% or less.

Therefore, when the weight point is substantially at the central portion, it is preferable to set the holding diameter to 90% or more and 100% or less of the lead diameter.

INDUSTRIAL APPLICATION FIELD

The lead holding structure of a mechanical pencil of the present invention can be applied as a lead holding structure of various mechanical pencils.

For example, the present invention is extremely effective for a mechanical pencil of a type in which a lead can be pushed out by shaking a shaft utilizing an inertial force of a weight and an impact is easily applied to the lead holding section of a chuck, and for a mechanical pencil of a type in which a lead can be pushed out with a small knock stroke, and the projected lead can be accommodated from a front end with a large knock stroke, and for a mechanical pencil of a type in which holding and sliding are repeated at the same location of a lead with respect to a lead holding section of a chuck.

EXPLANATION OF SYMBOLS

Figure 1:
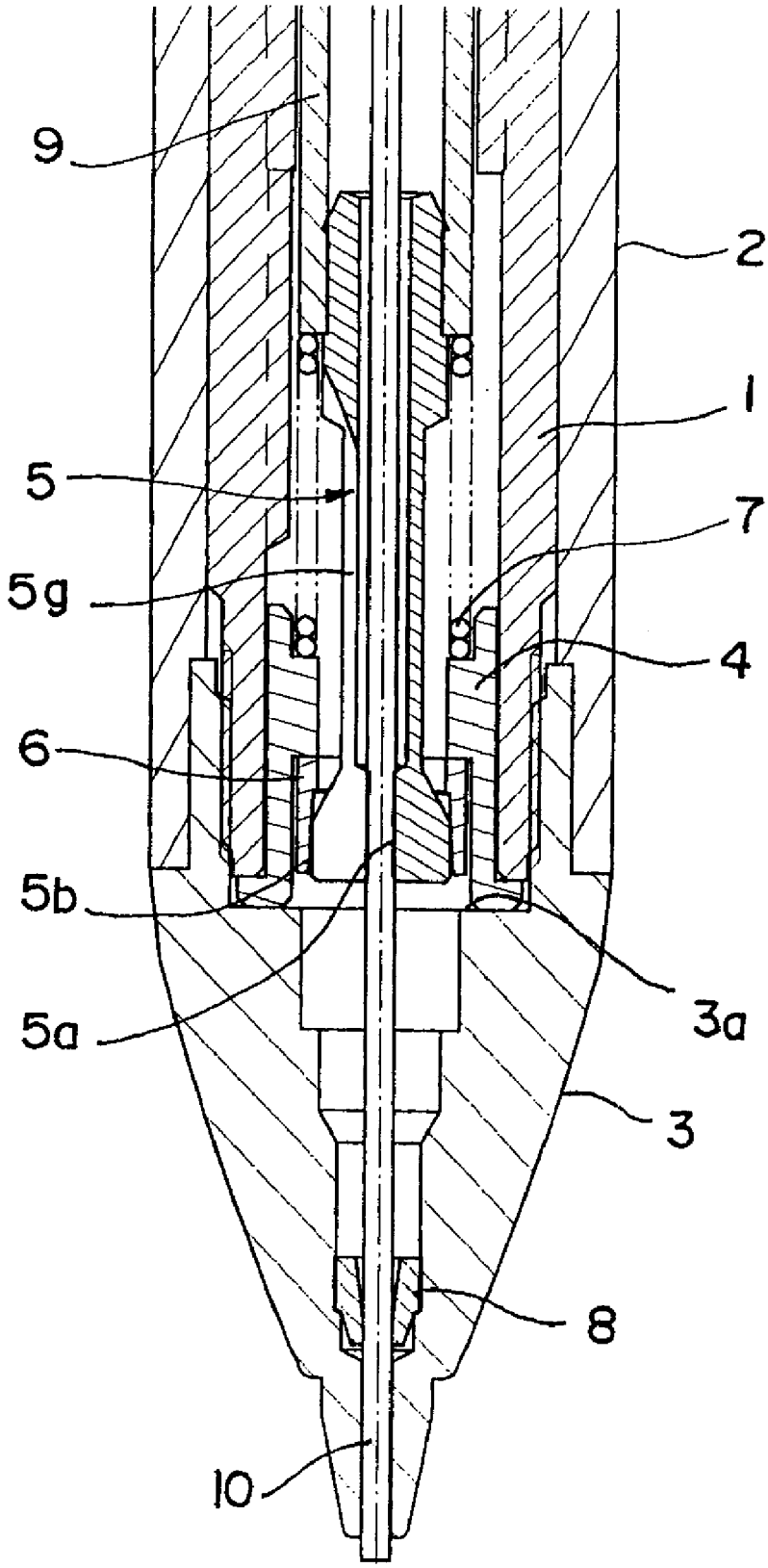
FIG. 1 is an enlarged vertical sectional view of an essential portion of a mechanical pencil of the present invention, and shows a state where a chuck holding a lead is retracted.
Figure 2:
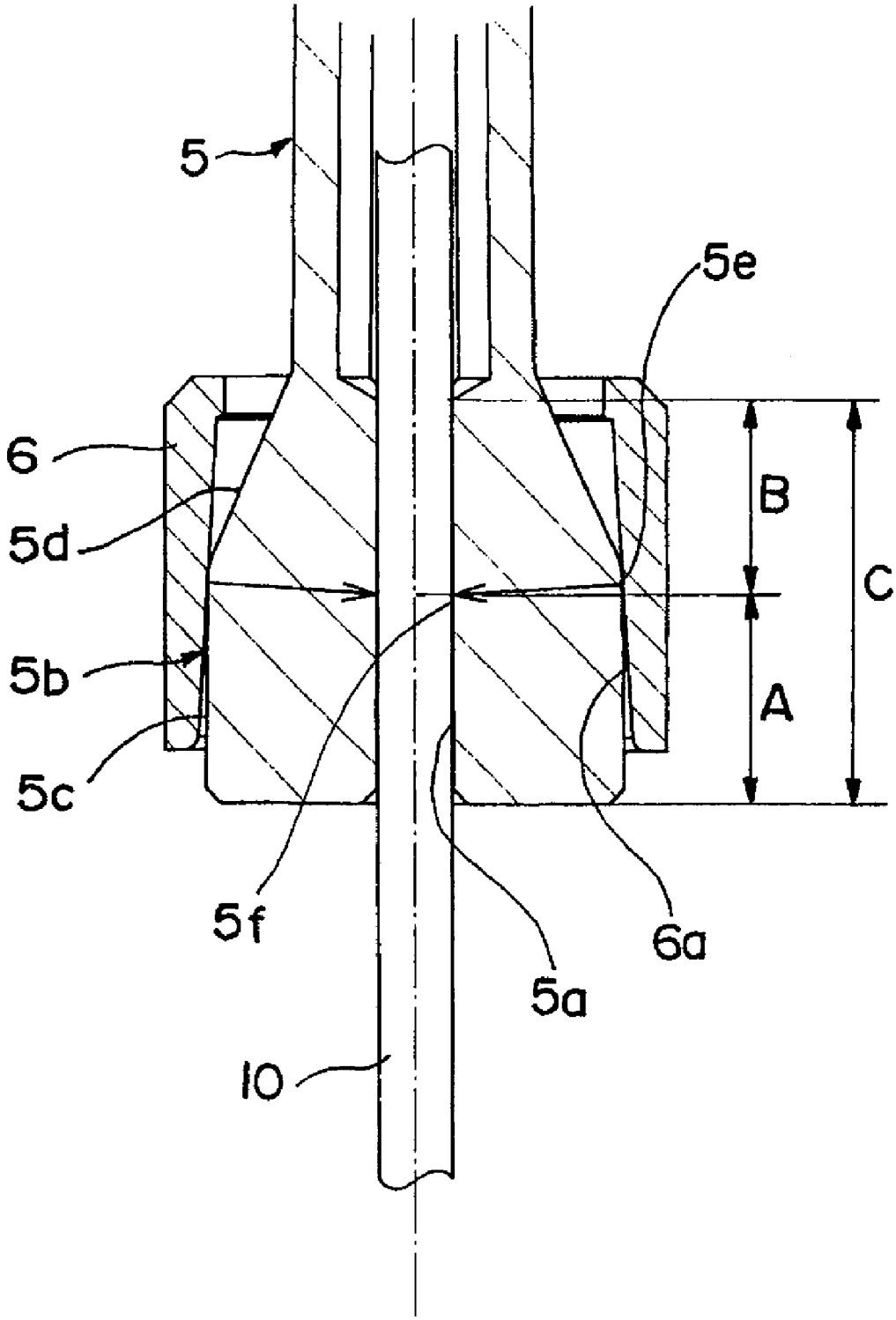
FIG. 2 is a sectional view of an essential portion of a lead holding mechanism showing a state where the lead is held.
Figure 3:
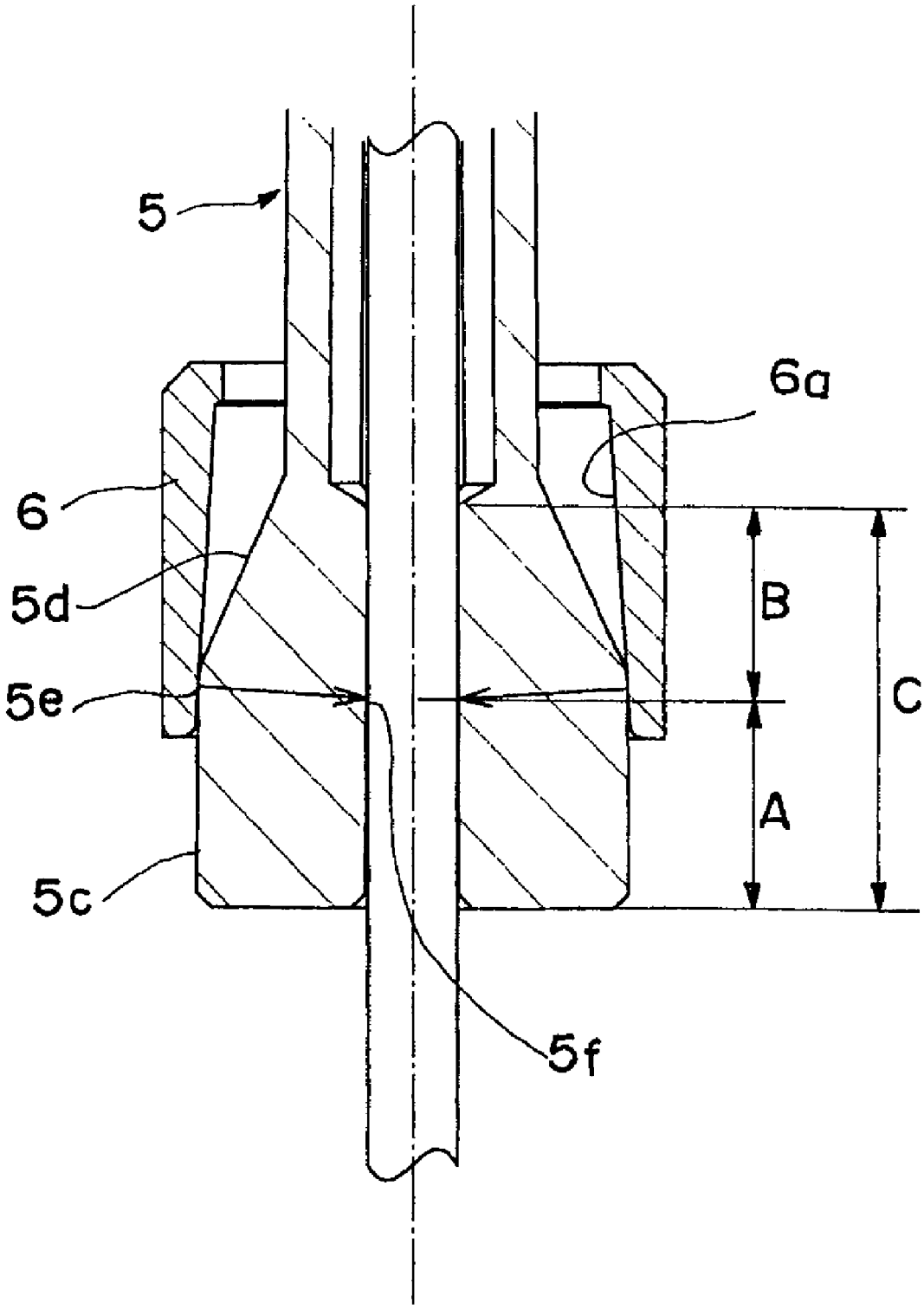
FIG. 3 is a sectional view of an essential portion of the lead holding mechanism showing a state where the lead is held.
Figure 4:
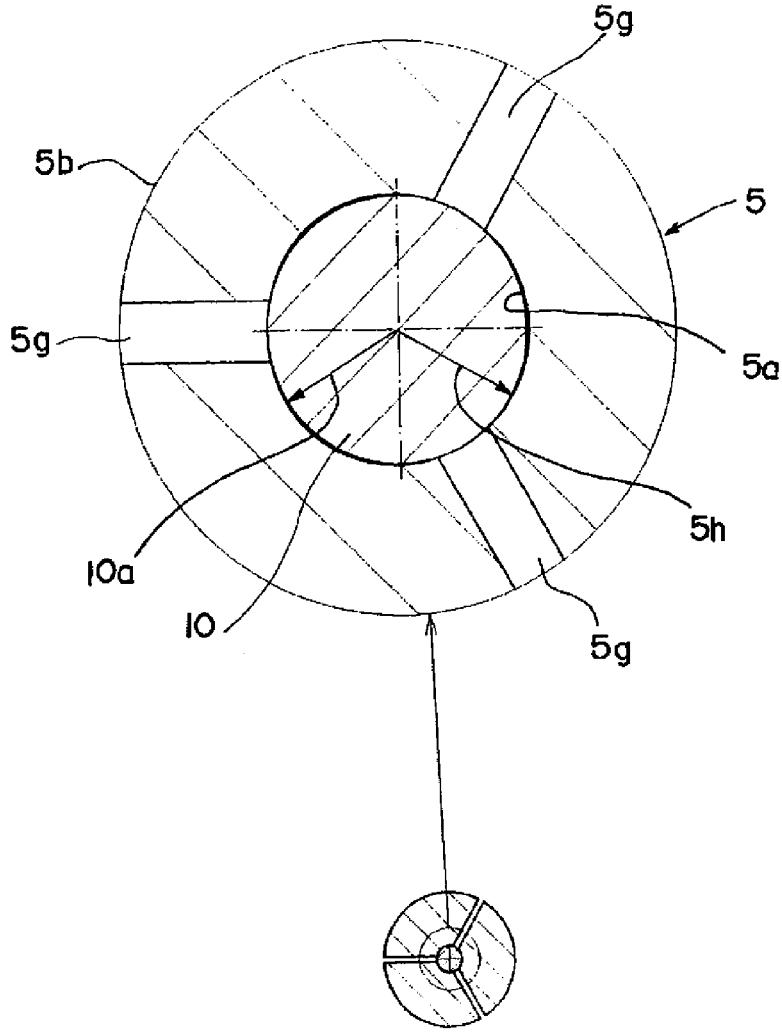
FIG. 4 is a transverse sectional view of an outer periphery of the chuck taken along the position of a lead holding section.
Figure 5:
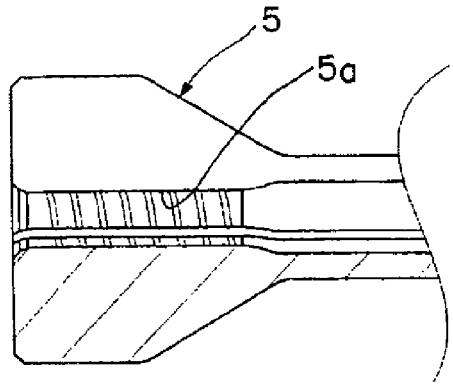
FIG. 5 is a diagram showing a state where projections and depressions are formed on the lead holding section of the chuck.
Figure 6:
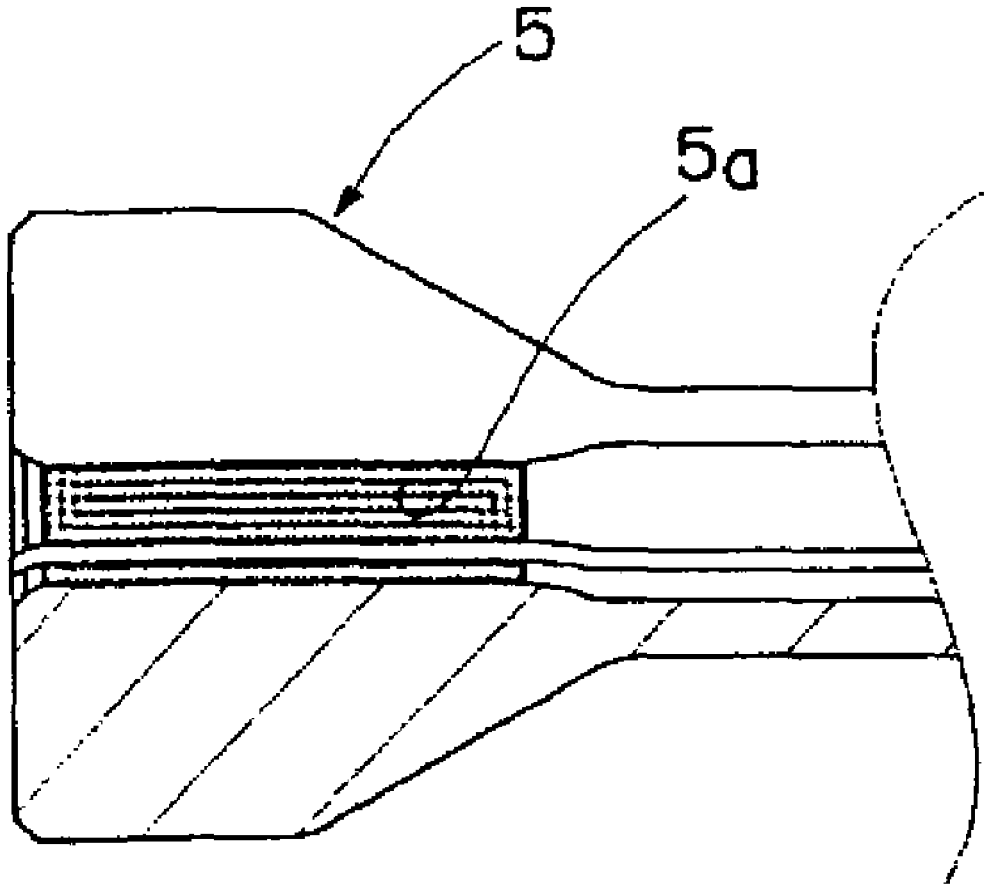
FIG. 6 is a diagram showing a state where projections and depressions are formed on the lead holding section of the chuck.
Figure 7:
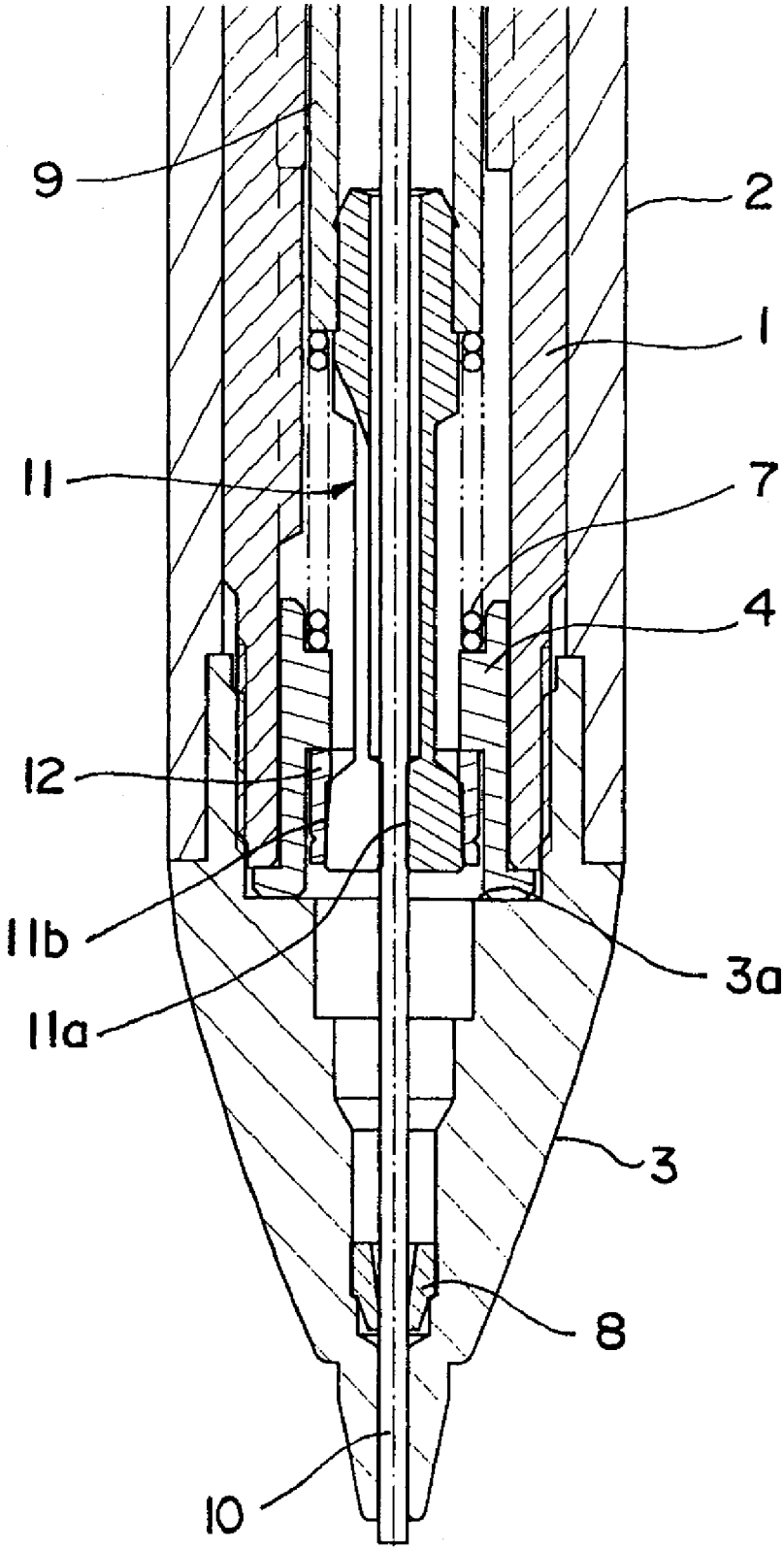
FIG. 7 is an enlarged vertical sectional view of an essential portion of a conventional mechanical pencil.
Figure 8:
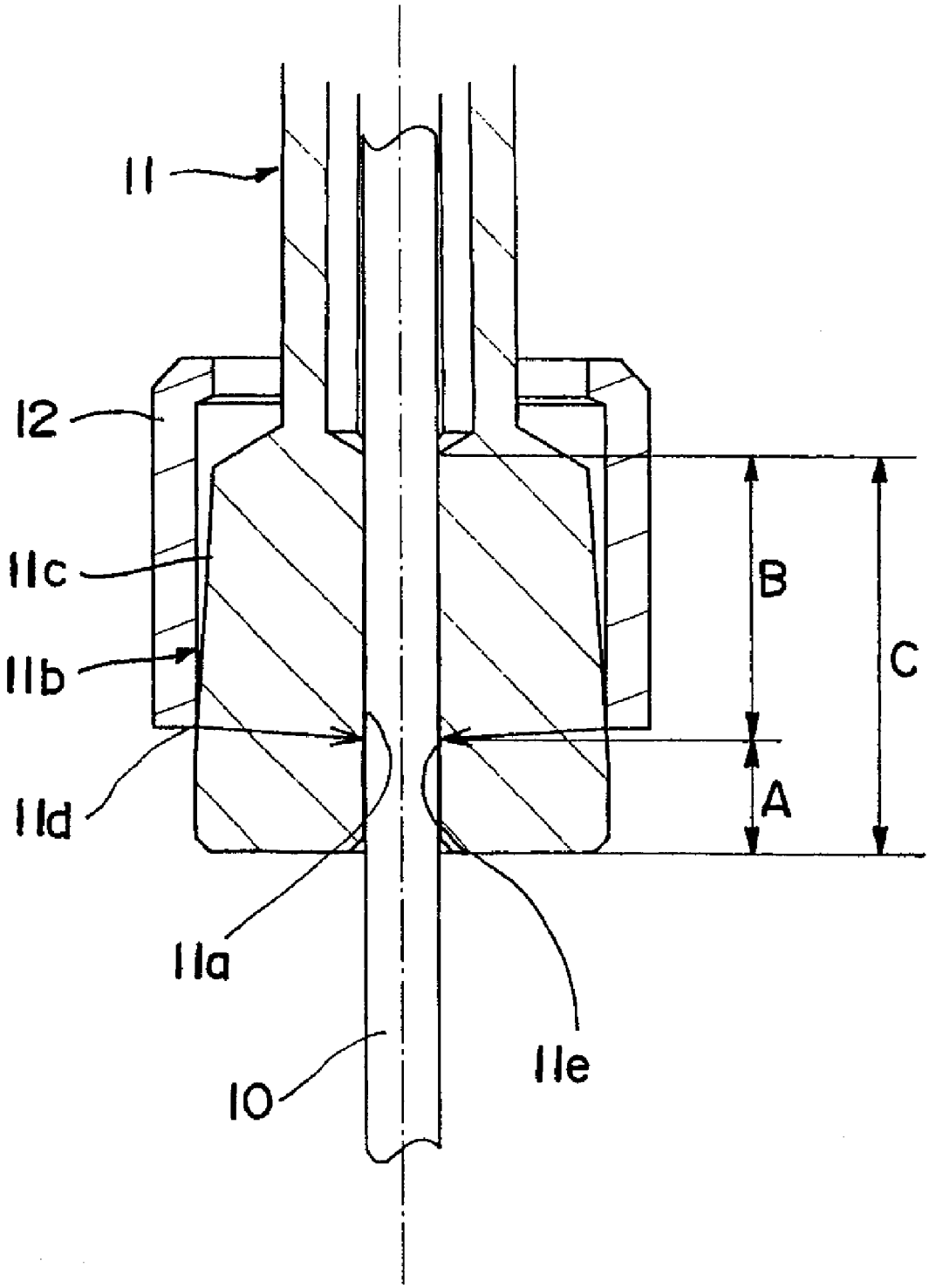
FIG. 8 is a sectional view of an essential portion of a lead holding mechanism showing a state where the lead is held.
Figure 9:
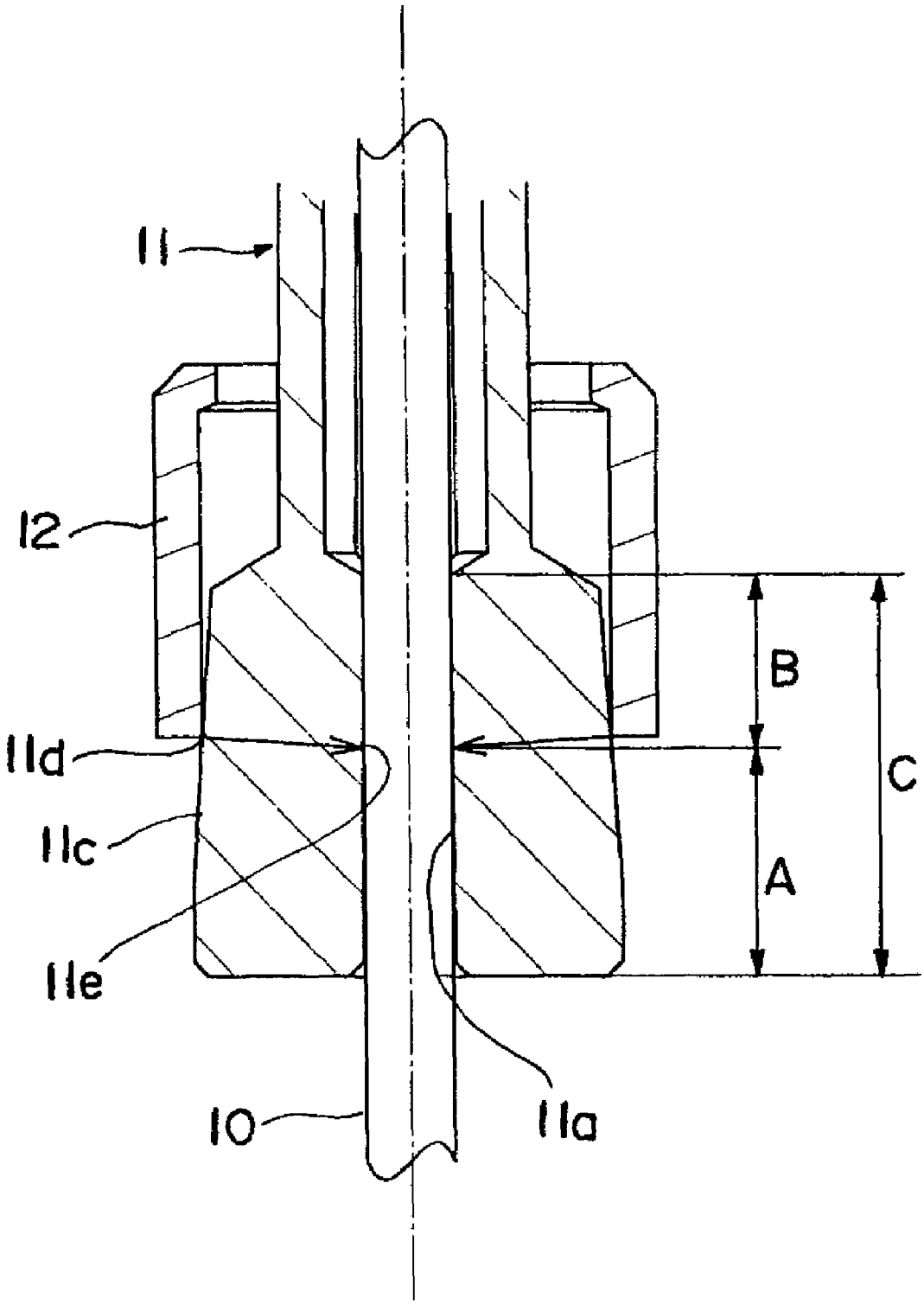
FIG. 9 is a sectional view of an essential portion of the lead holding mechanism showing a state where the lead is held.
Figure 10:
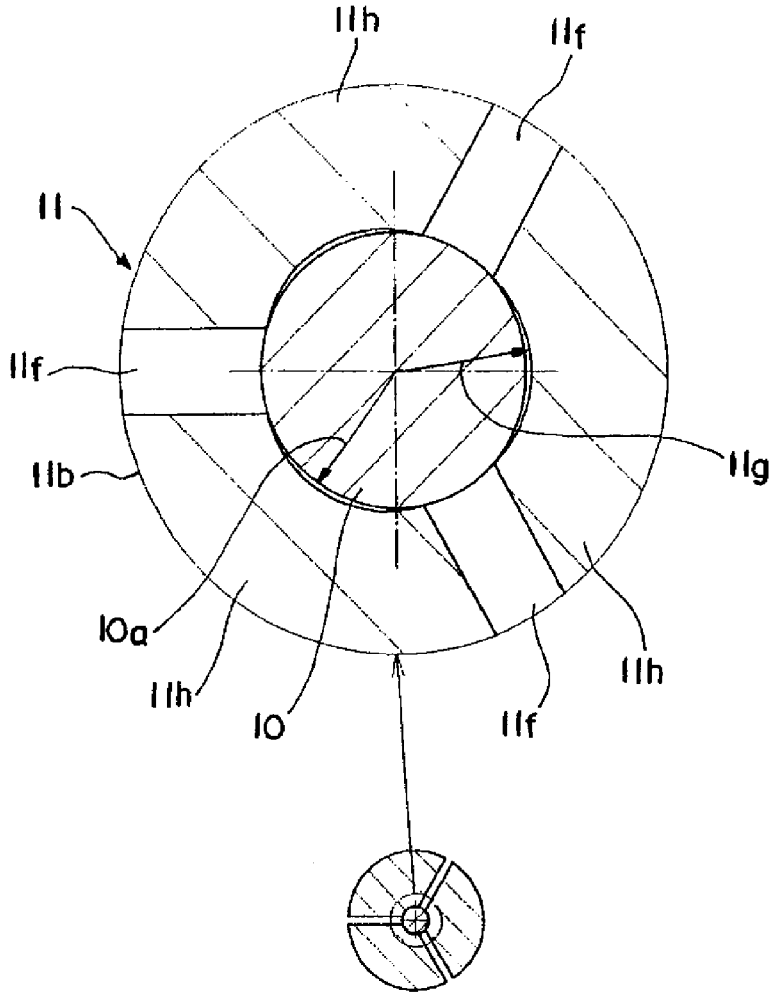
FIG. 10 is a transverse sectional view of an outer periphery of the chuck taken along the position of a lead holding section.
Figure 11:
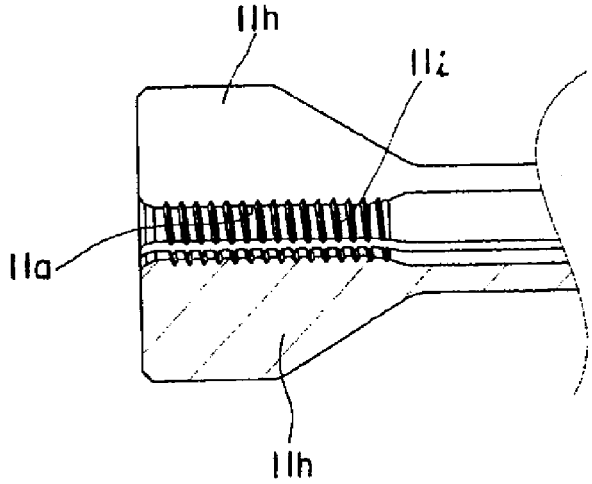
FIG. 11 is a diagram showing a state where projections and depressions are formed on the lead holding section of the chuck.

1 shaft cylinder
2 grip
3 front end
3*a* inner step
4 shaft coupling
5 chuck
5*a* lead holding section
5*b* outer periphery
5*c* horizontal section
5*d* inclined surface
5*e* contact point
5*f* load application point
5*g* slot
5*h* radius of curvature of lead holding section
6 fastener
6*a* inclined surface
7 chuck spring
8 holding chuck
9 lead case
10 lead
10*a* radius of curvature of lead
11 chuck
11*a* lead holding section
11*b* outer periphery
11*c* inclined surface
11*d* contact point
11*e* load application point
11*f* slot
11*g* radius of curvature of lead holding section
11*h* lead holding piece
12 fastener

The invention claimed is:

1. A lead holding structure of a mechanical pencil in which a lead is held through a fastener by forward and backward movements of a chuck disposed in front of a shaft cylinder, and the lead is pushed out, wherein a portion of an outer periphery of the chuck corresponding to a lead holding structure from a substantially central point to a front end of the outer periphery is formed as a peripheral surface which extends substantially parallel to an axis or which inclines toward the axis of the mechanical pencil, and a portion of the outer periphery from the substantially central point to a rear end of the outer periphery is formed as a surface which is perpendicular to the axis or as a peripheral surface which is inclined toward the axis, an inner periphery of the fastener to which the outer periphery of the chuck is formed as an inclined surface which is inclined toward the axis rearward at a predetermined angle, a radius of curvature of an inner periphery of the lead holding structure of the chuck is set in a range of 90% or more and 96% or less of a radius of the lead, when the chuck holds the lead and is fastened by the fastener, a central point of the outer periphery of the chuck becomes a contact point with respect to the inclined surface of the fastener, and a point at which a line perpendicular to the inclined surface from the contact point and the inner periphery of the lead holding structure of the chuck intersect with each other is a load application point of holding the lead, the load application point is set substantially at a center of a lead holding length.

2. The lead holding structure of the mechanical pencil according to claim 1, wherein an inner surface of the lead holding structure of the chuck is formed with projections and depressions of 10μ or less.

* * * * *